United States Patent [19]

Röder et al.

[11] Patent Number: 4,720,195

[45] Date of Patent: Jan. 19, 1988

[54] AGITATOR

[75] Inventors: Klaus W. Röder, Bad Nauheim; Konrad Probst, Schopfheim; Hans Schupper, Zell, all of Fed. Rep. of Germany

[73] Assignees: UHDE GmbH, Postfach; Ekato Ruhr-und Mischtechnik GmbH, Dortmund, both of Fed. Rep. of Germany

[21] Appl. No.: 868,943

[22] Filed: May 30, 1986

[30] Foreign Application Priority Data

Jun. 1, 1985 [DE] Fed. Rep. of Germany ..... 3519647

[51] Int. Cl.[4] ..... B01F 7/16

[52] U.S. Cl. ..... 366/342; 366/325

[58] Field of Search ..... 366/325, 326, 279, 285, 366/343, 342.43, 329.31, 297, 299, 25-26; 403/13, 14, 269, 271; 416/226

[56] References Cited

U.S. PATENT DOCUMENTS

| | | | |
|---|---|---|---|
| 69,248 | 9/1867 | Ranson | 366/342 |
| 1,400,216 | 12/1921 | Hechler | 366/326 |
| 2,298,899 | 10/1942 | Oswin | 403/13 |
| 4,126,250 | 11/1978 | Gram | 366/195 |
| 4,229,110 | 10/1980 | Lucke | 366/343 |
| 4,456,382 | 6/1984 | Mahler, II | 366/285 |
| 4,491,421 | 1/1985 | Koehl et al. | 366/325 |
| 4,655,605 | 4/1987 | Cipelletti | 366/312 |

FOREIGN PATENT DOCUMENTS

| | | | |
|---|---|---|---|
| 2312286 | 8/1974 | Fed. Rep. of Germany | 366/292 |

*Primary Examiner*—Harvey C. Hornsby
*Assistant Examiner*—Corinne M. Reinckens
*Attorney, Agent, or Firm*—Marhsall & Melhorn

[57] ABSTRACT

An agitator of impeller shape includes an agitator hub with a plurality of radially extending arms for attachment to a drive shaft for the mixing of substances in vessels, such as substances that tend to material build-up, incrustation and/or incipient polymerization. The hub is totally closed by welding a cap over the end of the hub. At least one of the agitator arms is formed of two components, a shorter stub arm attached to the hub and longer main arm. Both components are formed of a pair of parallel, spaced apart tubes connected by a pair of webs. Each tube includes a bushing for retaining a centering bolt to attach the main portion to the stub portion. The two components are then welded together and polished to remove any gaps and sharp edges.

1 Claim, 3 Drawing Figures

AGITATOR

BACKGROUND OF THE INVENTION

The invention relates to an agitator, particularly one of the impeller shape, consisting of a hub with a plurality of radially extending agitator arms for rotation in an agitator or mixing vessel.

Agitators are used for the mixing of substances that tend to material build-up, incrustation and/or incipient polymerization and which can change from the liquid state into the disperse or pasty state. It is essential to prevent material build-up, incrustation and/or incipient polymerization on the agitator so as not to impair its mixing function. Routine cleaning operations should leave the agitator residue free. Therefore, the number of gaps between adjacent components of the agitator should be minimized.

Agitators of different shapes are shown in the prior art. The anchor shape, the impeller shape and the propeller shape are some of the well-known designs. Depending upon the design of the agitator, the surface finish, enamelled or bright, and the size of the agitator vessel, the agitators can be of the single-part type or must be of the multi-part type. The type of agitator also depends upon the possible or economical diameter of the agitator vessel cover. An agitator vessel with a cover diameter equal to the vessel diameter will permit installation of a single-part agitator. If the agitator has a reduced diameter, the installation opening and the vessel cover can also be reduced with reference to the vessel diameter. However, some processes require a larger diameter agitator so that the cover diameter finally selected requires the use of a multi-part agitator.

SUMMARY OF THE INVENTION

The invention relates to a bright finish, multi-part agitator of impeller shape. This agitator can be installed in the vessel through a relatively small opening for subsequent assembly and attachment to the agitator shaft. Known designs include multi-part, at least two-part, agitators, especially of the impeller type. For example, a three agitator arm device can be formed as a single arm on one half of a hub and two arms on the other half of the hub, the two components each installed through a small opening into the vessel and bolted to the agitator shaft. This method of assembly will produce a multitude of sharp edges and gaps between the various components. Sharp edges and gaps are the starting points for material build-up, incrustations and/or incipient polymerization of the fluid media.

The agitator according to the present invention has a plurality of radially extending impeller arms. At least one of the arms is formed in two portions, a shorter stub portion on the hub and a longer main portion adapted to be attached to the stub portion after the hub has been inserted into a vessel. The stub and the main portion are both formed of a pair of parallel tubes spaced apart and connected by a pair of webs. Each tube includes a bushing for retaining a centering bolt which attaches the two arm portions. Then the edges of the portions are welded together and polished. After the hub has been installed on the agitator shaft, a cap is welded in place over the open end of the hub. The agitator is easily removed from the vessel by severing the arm and the cap at the welded joints.

An object of the present invention is to provide for a multi-part agitator which can be installed in a vessel with a small installation opening and the assembly is gap-free after installation.

The marked advantage offered by the present invention is the absence of any gap on the installed multi-part agitator in a vessel with small installation opening. Phenomena such as material build-up, incrustation and/or incipient polymerization are thereby prevented. Routine cleaning operations ensure complete absence of residues. Considering that such vessels are intended for batch operation, product residues might adversely affect the quality of the next batch.

BRIEF DESCRIPTION OF THE DRAWINGS

The invention is exemplified on the drawings and described in more detail below.

DESCRIPTION OF THE PREFERRED EMBODIMENT

Figure 1:
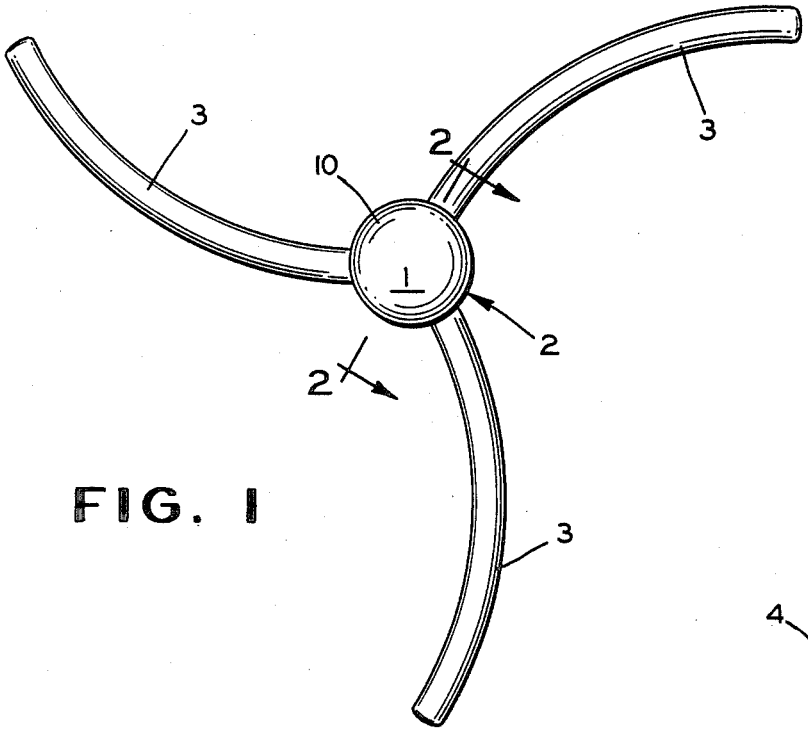
FIG. 1 is a plan view of an agitator according to the present invention.
Figure 3:
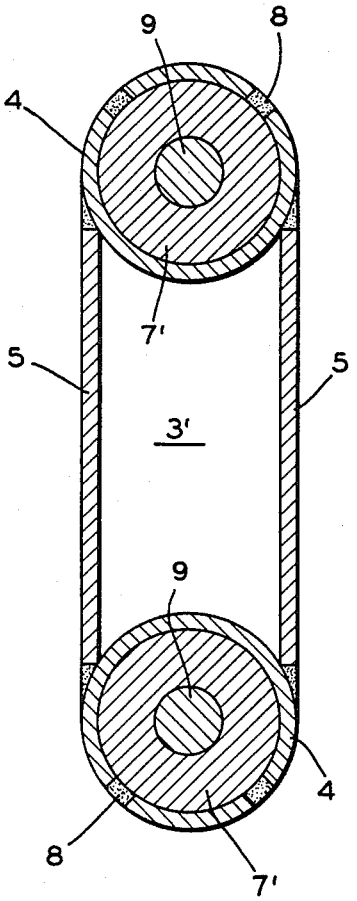
FIG. 3 is a sectional view of the agitator arm taken along the line 3—3 of FIG. 2.
Figure 2:
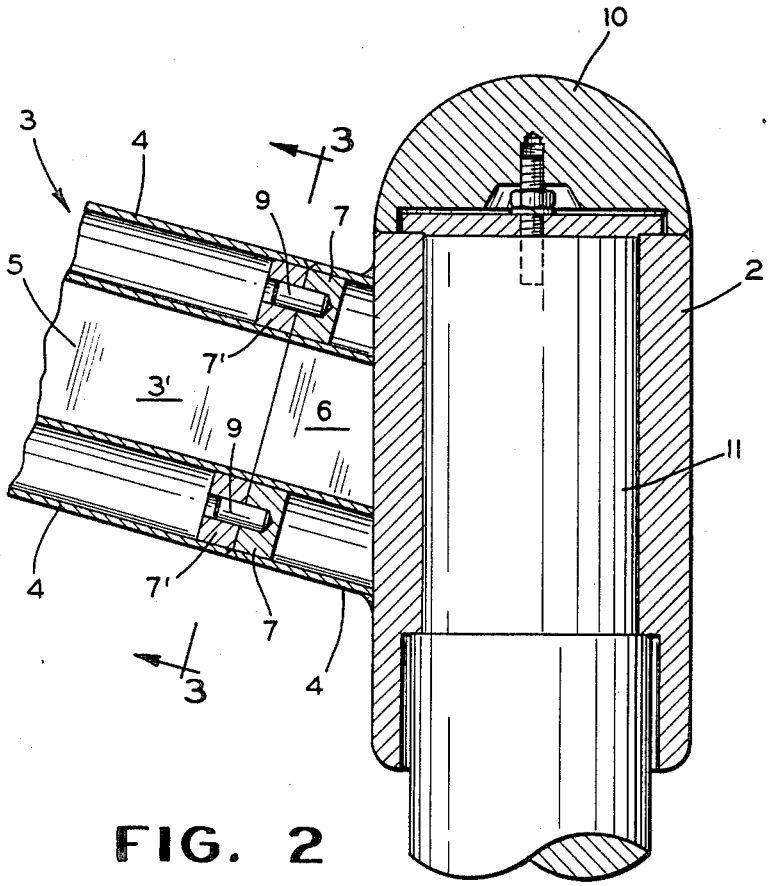
FIG. 2 is a sectional view of the agitator taken along the line 2—2 of FIG. 1.

The agitator 1 shown in FIG. 1 includes an agitator hub 2 which can be placed on and attached to an agitator shaft 11 in any known manner as shown in FIG. 2. A plurality of agitator arms 3 extend radially outwardly at a spacing of approximately 120°. Two of the agitator arms 3 are attached to the agitator hub 2. According to the invention, the third agitator arm can be attached to and removed from the agitator hub 2 as required. For this purpose, the agitator arm 3 shown in FIG. 2 is formed from a pair of generally parallel, spaced apart tubes 4 connected by a pair of webs 5 spaced apart and enclosing the space between the tubes. The arm is split into a shorter stub portion 6 and a longer main portion 3'. Stub portion 6 is rigidly attached to the agitator hub by means of a continuous weld. The two tubes 4 of the main portion 3' contain centering bushings 7' which are fixed in place by positioning welds 8 as shown in FIG. 3. The facing ends of the stub portion 6 contain similar centering bushings 7. Stub portion 6 and main portion 3' of the arm are positioned relative to each other and connected together through centering bolts 9 received in the centering bushings 7 and 7', respectively.

To install the agitator 1 into a vessel, the agitator hub 2 with the two rigidly attached arms is placed into the vessel through the installation opening and attached to the end of the agitator shaft 11. As shown in FIG. 2, the hub 2 is generally tubular and is open at both ends to receive the shaft 11. A cap 10 is placed over the end of the agitator hub 2, is welded in place and smoothed by polishing. The main portion 3' is placed into the vessel and installed on the stub portion 6 using the bolts 9. The gap between the two components is closed by welding. The weld is subsequently ground and polished to obtain a perfectly smooth surface.

To dismantle the agitator, the weld is cut precisely along its original line at the joint between the stub 6 and main portion 3'. Then the weld between the cap 10 and the hub 2 is cut.

For non-positive connection to the agitator shaft, the design of agitator hub 2 can be varied according to the prior art. The lower part of the hub can be shaped to serve as a flushing liquid reservoir for protecting the lower mechanical seal.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A agitator for use in a mixing vessel having a drive shaft and an opening through which the agitator can be inserted and removed, comprising:

a hub adapted to be connected to the drive shaft in the mixing vessel;

at least one radially extending arm having a smooth outer surface, said arm including a stub protion and a main portion, the stub and main portions of said one arm each including first and second spaced apart generally parallel longitudinally extending tubes;

means located totally within the first and second tubes of the stub portion and the main portion of said one arm for releasably connecting the stub portion of said one arm to the main portion of said one arm;

a first pair of spaced apart webs connecting the first and second spaced apart tubes of the stub portion of the said one arm, and a second pair of spaced apart webs connecting the first and second spaced apart tubes of the main portion of said one arm said webs completely enclosing said tubes and extending the entire length of said tubes thus creating a hollow space inside said one arm; and weld means joining said first and second webs of the respective stub portion and the main portion of said arm in abutting relation to form a completely smooth uninterrupted outer surface of said one arm.

* * * * *